United States Patent [19]

Plastino

[11] 4,439,871

[45] Apr. 3, 1984

[54] HEAD PROTECTING HEADWEAR

[76] Inventor: Mario A. Plastino, 659 Mastic Rd., Mastic, Long Island, N.Y. 11950

[21] Appl. No.: 369,646

[22] Filed: Apr. 19, 1982

[51] Int. Cl.[3] ..... A42B 3/00

[52] U.S. Cl. ..... 2/422; 2/183; 2/418; 2/421

[58] Field of Search ..... 2/422, 411, 412, 414, 2/417, 418, 175, 180, 185 R, 187, 195, 197, 199, 183

[56] References Cited

U.S. PATENT DOCUMENTS

| | | | |
|---|---|---|---|
| 3,103,015 | 9/1963 | Plastino | 2/422 |
| 3,203,003 | 8/1965 | Plastino | 2/422 |
| 3,314,078 | 4/1967 | Marchello | 2/421 |
| 3,435,460 | 4/1969 | Grant | 2/422 |
| 3,714,668 | 2/1973 | Mirabella | 2/419 |
| 4,345,336 | 8/1982 | Plastino | 2/187 |

*Primary Examiner*—Peter P. Nerbun

*Attorney, Agent, or Firm*—Gottlieb, Rackman & Reisman

[57] ABSTRACT

There is disclosed headwear including an outer head covering and a removable protective impact resistant shell. The outer head covering is provided with a crown portion having an integral bottom peripheral edge defining a shell receiving opening, and a brim extending outwardly and peripherally from the crown portion. The protective impact resistant shell includes a protective crown portion and an integral bottom rim configured to define a generally circular head receiving opening. A fastening arrangement including a strap is provided for securing the protective shell within the outer head covering. The strap has exterior sections which extend from the exterior surface of the protective shell through generally aligned openings in the outer head covering to secure the protective shell within the head covering.

16 Claims, 7 Drawing Figures

Figure 4:
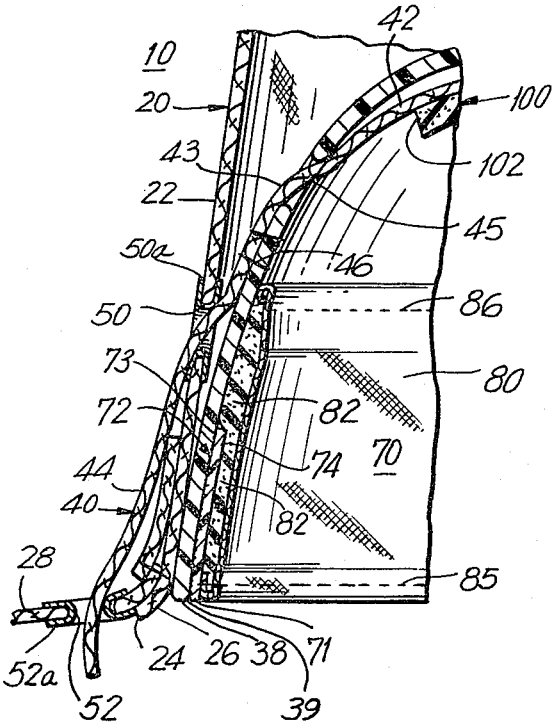

FIG. 1
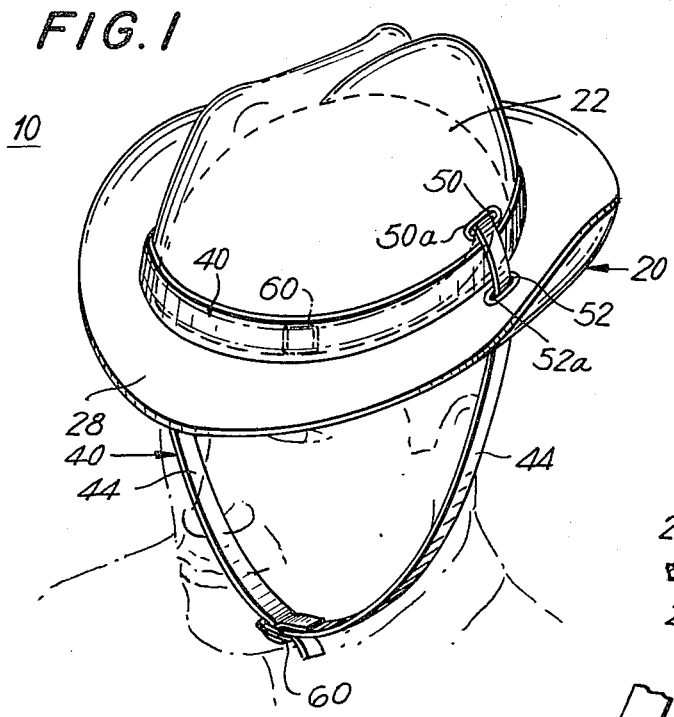
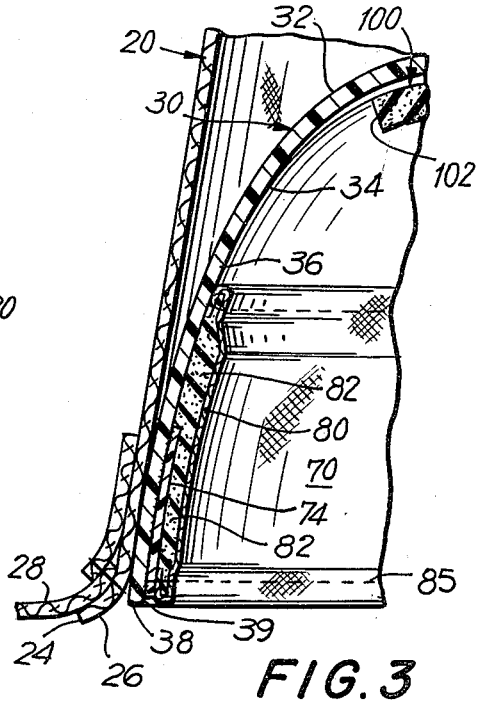
FIG. 3
FIG. 2
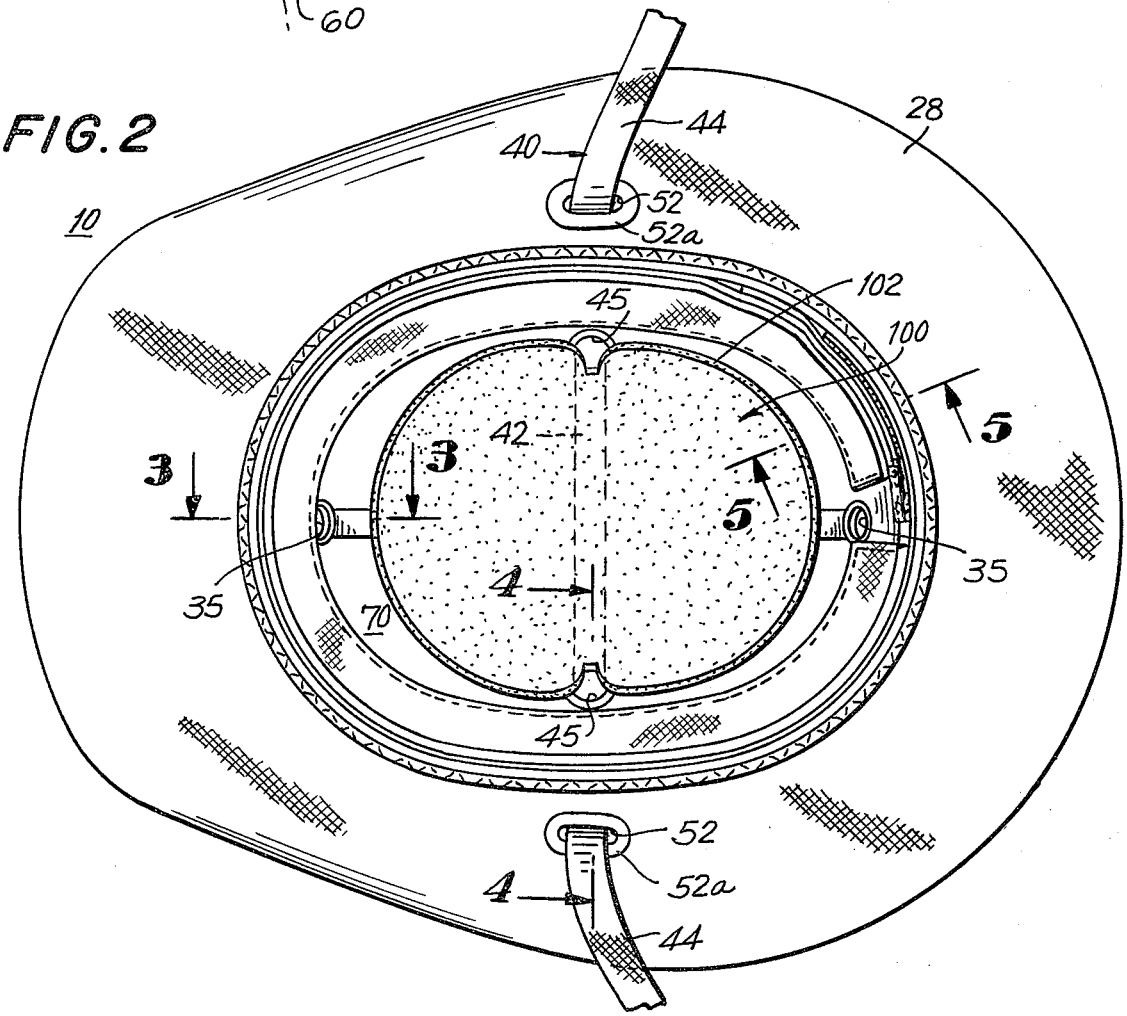

HEAD PROTECTING HEADWEAR

BACKGROUND OF THE INVENTION

This invention relates generally to protective headwear provided with an outer head covering and removable rigid impact resistant shell and, more particularly, to head protecting headwear of the type which is suitable for street dress, riding and other equestrian events.

Headwear of the type to which the present invention relates, is generally well-known in the art. Such headwear commonly includes an outer ornamental head covering, and a removable protective shell, which contains a shock absorbing interior, to absorb and snub blows received in the crown area of the headwear.

Headwear of the character described, as heretofore made, is exemplified by my prior U.S. Pat. Nos. 3,103,015 and 3,203,003. In these patents I disclose head protecting headwear capable of protecting the wearer against head injury, having particular advantage in providing a secure attachment of the protective shell within conventional styled outer head coverings without detracting from or calling attention to the wearer's appearance. In U.S. Pat. No. 3,103,015, this is accomplished by provision of a shell having a marginal peripheral edge portion adjacent the head receiving opening in the shell which fits within the sweatband of the outer head covering. In U.S. Pat. No. 3,203,003, a secure arrangement of the protective shell and the outer head covering is obtained by employment of outwardly extending recessed fastening studs positioned on the exterior surface of the protective shell and ornamentally headed screws which extend through the outer head covering to engage the studs and secure the head covering to the shell.

The present invention is directed to protective headwear which achieves a secure arrangement of a protective shell within an outer head covering in headwear which provides manufacturing advantages and economies by having a less complex design and lesser need for precise specification requirements than according the prior art. For example, the prior art headwear shown in my two aforementioned patents, are both provided with fastening structures for securing the protective shell within the outer head covering which must be fabricated in accordance with precise specification requirements in order to obtain a secure headwear arrangement. In the headwear disclosed in my U.S. Pat. No. 3,103,015, it is necessary to provide an outer head covering having a sweatband which fits in snug relation to the marginal portion of the protective shell to securely position the protective shell in engagement with the outer head covering. In the headwear of U.S. Pat. No. 3,203,003, the fastening studs of the protective shell must be securely fastened in aligned relation with corresponding openings in the outer head covering for engagement with securing screws. Alignment of the fastening studs and outer head covering openings, and secure positioning of the fastening studs on the exterior surface of the shell is critical to the operation of the headwear. Headwear which avoids the specification limitations of the prior art will provide manufacturing advantages and cost savings to the consumer.

Head protecting headwear, which provides an improved arrangement of a removable protective shell and an outer head covering, has the further advantage of facilitating replacement of the outer covering where the covering becomes soiled, faded or where the wearer desires to use a different styled cover. Thus, protective headwear with an improved arrangement of a protective shell and covering is not only more efficient to manufacture, but is more versatile in use than prior art headwear.

Accordingly, it is the primary object of the present invention to provide head protecting headwear suitable for street dress, riding and equestrian events, of the character described, providing improved manufacturing advantages by having fewer, less complex parts and having a lesser need for precise tolerances than protective headwear according to the prior art.

Another object of the present invention is to provide head protecting headwear including a removable protective shell which may be securely positioned on the head of a wearer.

Another object of this invention is to provide head protecting headwear including a removable protective shell which will permit replacement of the outer head covering when damaged or for purposes of providing different styled outer head coverings.

Another object of the invention is to provide head protecting headwear which is adjustable to accommodate a range of head sizes for an improved and secure placement of the headwear on the head of a wearer.

A still further object of the invention is to provide head protecting headwear having a western styled look.

In the present invention, these purposes, as well as others which will be apparent, are achieved generally by providing head protecting headwear including an outer head covering having a crown portion, a shell receiving opening defined at the bottom of the crown portion and a brim extending outwardly and peripherally from the crown portion. The outer head covering houses a protective impact resistant shell having interior and exterior surfaces, a protective crown portion and an integral bottom rim configured to define a generally circular head receiving opening. The protective shell is positioned in conforming engagement with the head covering by a securing means including a strap which is secured to the protective shell, and an arrangement of strap openings in the crown portion and brim of the outer head covering which receive the strap to secure the protective shell within the head covering. Advantageously, the securing strap may be provided in the form of an adjustable chin strap for securely positioning the headwear on the head of a wearer.

Figure 5:
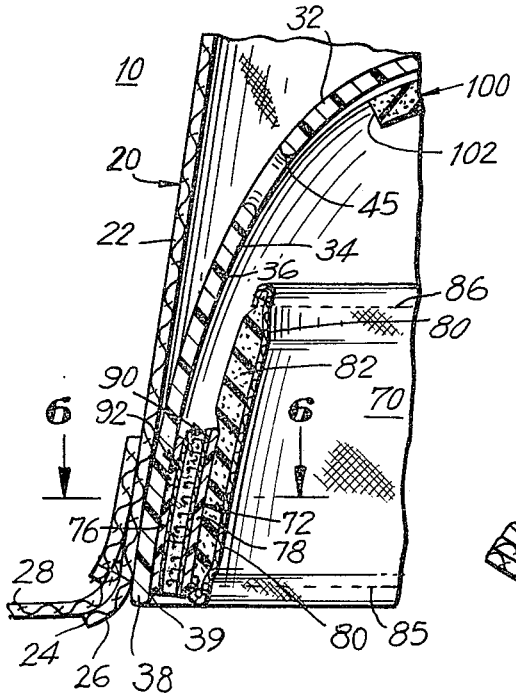
Figure 7:
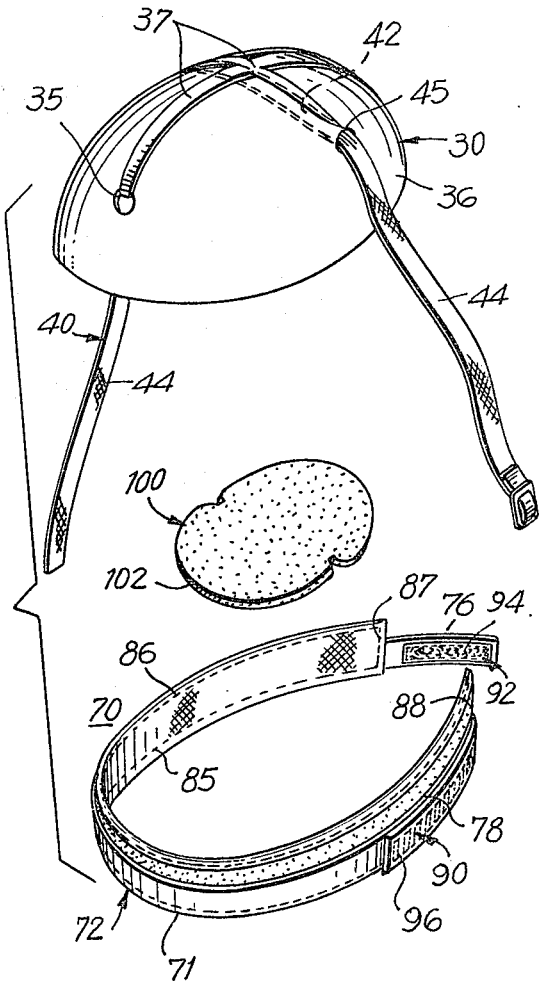
Figure 6:
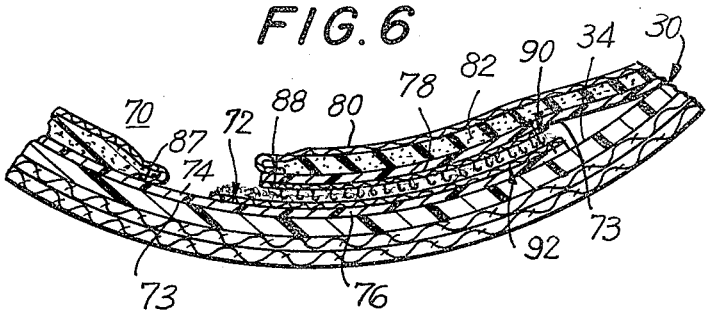

Further objects and features of the present invention will become more apparent with reference to the following detailed description of the presently preferred but nevertheless illustrative embodiments of the invention, when taken in conjunction with the following drawings, wherein:

FIG. 1 - is a front perspective view of head protecting headwear in accordance with the present invention;

FIG. 2 - is a bottom perspective view of the headwear of FIG. 1 showing a protective shell positioned within the outer head covering;

FIG. 3 - is a partial sectional view, taken along the line 3—3 of FIG. 2;

FIG. 4 - is a partial sectional view, taken along line 4—4 of FIG. 2 showing the manner in which the securing strap interengages the outer head covering and the protective shell;

FIG. 5 - is a partial cross-sectional view, taken along line 6—6 of FIG. 2 showing the adjustable sweatband including overlapping connecting sections provided with "Velcro" adhesives;

FIG. 6 - is a partial sectional view taken along line 6—6 of FIG. 5 showing the manner in which the "Velcro" adhesives of the sweatband engage to permit adjustment of the sweatband size; and FIG. 7 - is an exploded view of the protective shell of this invention including the securing strap, high impact liner, and an adjustable sweatband.

Referring now to the drawings, and more particularly, to FIGS. 1–5 thereof, head protective headwear according to the present invention is generally designated 10. The head protective headwear 10 includes an outer head covering 20, and a protective shell 30 which is removably housed within the head covering 20 in secure locking engagement. The outer head covering 20 has a crown portion 22, an integral bottom peripheral edge 24 defining a shell receiving opening 26 and a brim 28 extending outwardly and peripherally from the crown portion 22. The crown portion 22 of the head covering 20 is preferably formed of a loose-weave material or provided with spaced air vents (not shown) to permit circulation of air within the headwear 10.

The protective impact resistant shell 30, preferably formed of a rigid synthetic plastic, has exterior and interior surfaces 32, 34 respectively, a protective crown portion 36, and an integral bottom rim 38 configured to define a generally circular head receiving opening 39. To provide improved rigidity and resistance to impact, the protective shell 30 may be provided with outwardly extending longitudinally and transversely extending ridges 37, shown in FIG. 7, in crown portion 36. Air circulation within the protective shell 30 is provided by peripherally spaced air vent openings 35 which cooperate with the loose-weave material or vent holes of the crown portion 22 of the outer head covering 20 to provide an improved comfort fit.

The protective shell 30 is positioned in conforming engagement with the head covering 20 by a securing means including a strap 40 and an arrangement of strap receiving openings 50, 52 in the crown portion 22 and outwardly extending brim 28 of the outer head covering 20. Strap receiving openings 50, 52 are preferably reinforced with rectangular metal eyelets **50*a*, 52*a* in order to facilitate arrangement of the strap 40 in secure relation with strap openings 50, 52. The strap 40 is preferably formed of a woven fabric or stretchable nylon and has an interior section 42 affixed to the apical portion of the interior surface 32 of the protective shell 30 (shown in dashed lines in FIGS. 2 and 7), and open ended exterior sections 44 integral with the interior section 42 which extend through perpherally spaced apertures 45 in the protective shell 30. The apertures 45 are spaced from the head receiving opening 39 of the protective shell 30, so that the strap 40 does not obstruct placement of the headwear 10** on the head of a wearer.

The exterior sections 44 of the securing strap 40 have portions 43 which are secured adjacent apertures 45 to the exterior surface 34 of the protective shell 30 by staples 46 or other conventional securing means (see FIG. 4). This provides a secure attachment of the strap 40 to the protective shell 30, and also permits alignment of exterior strap sections 44 in substantial registry with the strap receiving openings 50 in the crown portion 36 of the outer head covering 20. A secure engagement of the protective shell 30 within the outer head covering 20 is obtained by extending exterior sections 44 outwardly through strap receiving openings 50 in the crown portion 22 of the head covering 20 and then downwardly through aligned strap receiving openings 52 in the peripheral brim 28. Further advantage is obtained by fastening the exterior strap sections 44 through the strap receiving openings 50, 52 in taut relation to the head covering 20 and protective shell 30. To this end, the exterior strap sections 44 may be fastened together with a conventional buckle 60 to provide a chin strap for positioning the headwear 10 on a wearer's head (see FIG. 1). When the strap 20 is not in use it may be secured around the periphery of the crown portion of the outer head covering 20 adjacent the peripherally extending brim 28. This latter position of the strap 40 is shown by the dot and dash line in FIG. 1.

A sweatband, generally designated 70, is secured to the interior surface 32 of the protective shell 30 with its lower edge 71 in substantial registry with the bottom peripheral rim 38 of the protective shell. Sweatband 70 has a backing member generally designated 72, preferably formed of a flexible material, such as a relatively thick polyethylene sheet material, having interior and exterior surfaces 73, 74 respectively. A layer of absorbent sweatband material 80 is secured to the backing member 72 by stitching 85 extending peripherally around the lower edge 71 of the sweatband 70 adjacent the peripherally extending rim 38 of the protective shell 30. The backing 72 and absorbent sweatband material 80 are separated by a circumferentially extending layer of foam 82 or similar material. A secure arrangement of the foam layer 82 and absorbent sweatband material 80 is provided by a second peripherally extending line of stitching 86 extending through foam layer 82 and sweatband layer 80, the latter folded over the foam layer 82 at its upper edge.

To provide an adjustability feature for the sweatband 70, the backing member 72 is provided with overlapping open end portions 76, 78 which may be interengaged by a conventional securing means to vary the circumference of the sweatband 70 and thereby accommodate different head sizes. As best shown in FIG. 7, absorbent sweatband layer 80 and foam layer 82 are noncontinuous in order to permit adjustment without introducing an undesirable bulge when the open end portions 76, 78 of backing 72 are secured in overlapping relation. Absorbent sweatband and foam layers 80, 82 are secured together by transverse extending stitching lines 87, 88 with sweatband layer 80 overlapping the transverse edge portion of foam layer 82 to provide a secure sweatband 70 arrangement.

In the illustrated embodiment of the invention, the means for adjustably interengaging the overlapping backing end portions 76, 78 consists of a fastening panel 90 carried on the exterior surface 73 of backing end 78 and a cooperating fastening panel 92 carried on the interior surface 74 of backing end 76. The complimentary fastening panels 90 and 92 are fabricated of a synthetic adhesive commonly sold under the trademark "Velcro". The panel 92 consists of a plurality of "hooks" 94 which adhesively engage "Velcro" matting 96 of panel 90.

To provide reserve protection for a wearer of the headwear 10, the protective shell 30 may include a molded interior liner 100 having shock absorbing characteristics. The molded liner 100, shown in FIGS. 2 and 7, is configured to fit the contours of the wearer's skull in close fitting relation. For this purpose, I find it advantageous to provide a liner 100 having an outer peripheral edge 102 spaced from the peripherally extending rim 38 of the protective shell 30. While any form of such a liner conventionally employed in the prior art may be utilized in connection with the headwear of the present invention, I prefer to use a molded liner 100 formed of a stiffly compressible material, such as a high-energy absorbing close-grain polystyrene foam formed of expandable granular polystyrene.

It will be appreciated, therefore, that the present invention provides head protecting headwear 10, particularly suitable for street dress which achieves the objects stated heretofore. In particular, the present invention provides head protecting headwear 10 having a decorative outer head covering 20 and a removable impact resistant shell 30 which is economical to manufacture. Protective shell 30 is securely positioned within the head covering by a securing means of uncomplicated design including a strap 40 and a novel arrangement of strap receiving openings 50, 52 in the outer head covering 20 prevent displacement of the headwear 10 from the head of a wearer, the securing strap 40 cooperates with a conventional buckle 60 to provide a chin strap. An adjustable sweatband 70, which provides a head size adjustment feature for the headwear 10, and a high impact liner 100 cushion the head of a wearer upon impact of the headwear 10.

Advantageously, the outer head covering 20 may be readily removed from the protective shell 30 for cleaning or replacement of the covering 20 when it becomes worn or damaged. In this connection, it will be appreciated that the uncomplicated fastening arrangement of this invention facilitates removal and replacement of the head covering 20 effecting economies in use of the headwear 10.

Further advantage is obtained by securely affixing the strap 40 to the protective shell 30. This assures a stable arrangement of the protective shell 30 on the head of a wearer when the headwear 10 is subjected to impact. The securing strap 40 in combination with strap receiving openings 50, 52, reenforced with eyelets **50*a*, 52*a*, provide headwear 10** which is not subject to displacement from the head of a wearer.

Numerous modifications are possible in light of the above disclosure. By way of example, although a western style hat is illustrated in the drawings, it will be appreciated that the securing arrangement of the present invention is suitable for other headwear cover styles which have an outwardly extending brim for accommodating the securing strap arrangement of this invention. Similarly, although a "Velcro" fastening means has been disclosed for providing an adjustable sweatband 70, other means of interengaging the overlapping sections 76, 78, of the sweatband 70 may be employed.

It is understood, therefore, that the above described embodiments are merely illustrative and other embodiments may be devised by those skilled in the art, without departing from the spirit or scope of the present invention, as set forth in the appended claims.

There is claimed:

1. Headwear for protecting the head of a wearer comprising an outer head covering having a crown portion, an integral bottom peripheral edge defining a shell receiving opening, and a brim extending outwardly and peripherally from the crown portion, a protective rigid impact resistant shell removably disposed within said head covering, said protective shell having a protective crown portion with interior and exterior surfaces, and an integral bottom rim defining a generally circular head receiving opening, and means for removably securing said protective shell in conforming engagement with said outer head covering, said securing means including a strap having exterior sections which extend from the exterior surface of said protective shell, and strap receiving openings in the crown portion of the outer head covering and in said peripherally extending brim of said outer head covering, said exterior strap sections extending through said strap receiving openings of said outer head covering to secure said protective shell in engagement with said head covering.

2. Head protecting headwear according to claim 1 wherein said strap receiving openings are positioned in generally aligned relation with said exterior strap sections.

3. Head protecting headwear according to claim 2 wherein said strap receiving openings in said head covering are reinforced with eyelets.

4. Head protecting headwear according to claim 3 wherein said protective shell includes peripherally spaced apertures, and wherein said strap includes an interior strap section integral with said exterior strap sections which extends through the apertures of said protective shell.

5. Head protecting headwear according to claim 4 wherein said interior strap section is connected to the interior surface of said protective shell.

6. Head protecting headwear according to claim 5 wherein said exterior strap sections, include portions which are secured to the exterior surface of said protective shell.

7. Head protecting headwear according to claim 6 further comprising a high impact liner affixed to the interior surface of said protective shell for cushioning the head of a wearer.

8. Head protecting headwear according to claim 7 further comprising an adjustable sweatband disposed within said protective shell.

9. Head protecting headwear according to claim 8 wherein said adjustable sweatband is secured to the bottom peripheral edge section of said protective shell, said sweatband having a bottom edge in substantial registry with the bottom peripheral rim of said protective shell.

10. Head protecting headwear according to claim 9 wherein said sweatband includes a layer of cushioning material.

11. Head protecting headwear according to claim 10 wherein said high impact liner is spaced inwardly from said sweatband.

12. Head protecting headwear according to claim 11 further comprising a buckle for removably securing said depending strap sections together to provide a chin strap for positioning the headwear on the wearer's head.

13. Head protecting headwear according to claim 12 wherein said protective shell is fabricated of a rigid plastic.

14. Head protecting headwear according to claim 13 wherein said protective shell includes peripherally spaced air vents.

15. Head protecting headwear according to claim 14 wherein said protective shell includes an outwardly disposed ridge for strengthening said protective shell and providing improved resistance to impact.

16. Head protecting headwear according to claim 15 wherein said high impact liner is fabricated of an energy absorbing high density styrofoam.

* * * * *